US010290169B2

(12) United States Patent
Yanarella, Jr. et al.

(10) Patent No.: US 10,290,169 B2
(45) Date of Patent: May 14, 2019

(54) USE OF SPACERS TO ACCOMMODATE LESS THAN A CAPACITY NUMBER OF COINS IN A ROLL OF COINS IN A CASE

(71) Applicant: Numismatic Guaranty Corporation, Sarasota, FL (US)

(72) Inventors: Joseph R Yanarella, Jr., Wellington, FL (US); Stephen Lam, Hong Kong (CN); Max Spiegel, Sarasota, FL (US)

( * ) Notice: Subject to any disclaimer, the term of this patent is extended or adjusted under 35 U.S.C. 154(b) by 0 days.

(21) Appl. No.: 15/919,206

(22) Filed: Mar. 12, 2018

(65) Prior Publication Data

US 2018/0308306 A1 Oct. 25, 2018

Related U.S. Application Data

(63) Continuation of application No. 15/492,764, filed on Apr. 20, 2017, now Pat. No. 9,916,711.

(51) Int. Cl.
*G07D 9/04* (2006.01)
*G07D 9/00* (2006.01)

(52) U.S. Cl.
CPC ..... *G07D 9/004* (2013.01)

(58) Field of Classification Search
CPC ..... G07D 9/004
USPC ..... 206/0.8, 445, 303, 499, 516
See application file for complete search history.

(56) References Cited

U.S. PATENT DOCUMENTS

D992,087 5/1911 Vandervoort
1,037,551 A 9/1912 Isaac
2,527,389 A 10/1950 Becker
3,073,432 A 1/1963 Low et al.
3,083,818 A 4/1963 Lynghave et al.
3,135,566 A 6/1964 Frank
3,244,272 A 4/1966 Beamen et al.
3,292,779 A 12/1966 Colella
3,312,336 A 4/1967 Fally
3,346,109 A 10/1967 Duran
3,624,832 A * 11/1971 Dunn ..... A47G 1/12 206/0.83
3,877,571 A 4/1975 Sanford
(Continued)

OTHER PUBLICATIONS

Amazon.com '1 Cap-Tube & 20 Direct Fit H-40 Air-Tite Coin Holder Capsules for American Silver Eagle Coins by OnFireGuy', Accessed on Apr. 5, 2018.

(Continued)

*Primary Examiner* — Ernesto Grano
(74) *Attorney, Agent, or Firm* — Patent GC LLC; Alexander Franco

(57) ABSTRACT

A standard sized coin roll holder is loaded with a stack of alternating coins and spacers such that a variable number of coins can be accommodated in a standard sized holder. The number of coins loaded into the holder can be configured to be one more than the number of spacers, starting with a coin, then a spacer and so on, such that a coin occupies both the first position and the last position in the stack and making a coin face visible at each end. A twenty coin holder can be loaded, for example, with 10 coins and 9 spacers or with 5 coins and 4 spacers. A compressible silicone rubber washer can also be included to account for slight variations in coin thickness, thus securing the stack within the available height inside a closed and sealed case.

20 Claims, 9 Drawing Sheets

(56) References Cited

U.S. PATENT DOCUMENTS

| | | | | | |
|---|---|---|---|---|---|
| 3,998,238 | A * | 12/1976 | Nigro | G07D 1/08 | 221/279 |
| 3,999,563 | A | 12/1976 | Frias, Jr. | | |
| 4,036,358 | A | 7/1977 | Kelley | | |
| 4,063,639 | A | 12/1977 | Grant | | |
| 4,165,573 | A * | 8/1979 | Richards | A44C 3/00 | 206/0.8 |
| 4,184,590 | A * | 1/1980 | Tenbrink, Sr. | G07D 9/004 | 206/0.82 |
| 4,240,544 | A | 12/1980 | Barnhart et al. | | |
| 4,290,523 | A | 9/1981 | Wallace | | |
| D262,749 | S | 1/1982 | Taivalvuo | | |
| 4,541,528 | A | 9/1985 | Holmes | | |
| 4,595,100 | A | 6/1986 | Chabot | | |
| 4,715,492 | A | 12/1987 | Holmes | | |
| 5,152,399 | A * | 10/1992 | Keenaghan | A44B 15/005 | 206/0.81 |
| 5,499,710 | A * | 3/1996 | Hoffman | A45C 1/02 | 206/0.81 |
| 6,119,865 | A * | 9/2000 | Kawada | H01L 21/67369 | 206/303 |
| D443,126 | S | 5/2001 | Reviea et al. | | |
| 6,709,325 | B2 | 3/2004 | Korsen | | |
| 6,851,551 | B2 | 2/2005 | Lemaire | | |
| 7,040,487 | B2 * | 5/2006 | Zabka | H01L 21/67353 | 206/454 |
| 7,395,921 | B2 | 7/2008 | Errera | | |
| 7,490,716 | B2 | 2/2009 | Pleven | | |
| D596,375 | S | 7/2009 | Thomas | | |
| 7,784,607 | B1 | 8/2010 | Thomas | | |
| 8,061,512 | B2 | 11/2011 | Thomas | | |
| 8,376,133 | B2 | 2/2013 | Macor | | |
| 8,550,239 | B2 | 10/2013 | Nakonechny | | |
| 9,916,711 | B1 | 3/2018 | Yanarella, Jr. et al. | | |
| 2003/0162489 | A1 | 8/2003 | Korsen | | |
| 2004/0068898 | A1 | 4/2004 | Macor | | |
| 2005/0167288 | A1 * | 8/2005 | Sottile | A44B 15/005 | 206/38.1 |
| 2006/0011494 | A1 | 1/2006 | Squadroni | | |
| 2006/0052045 | A1 | 3/2006 | Lambert | | |
| 2006/0237334 | A1 | 10/2006 | Errera | | |
| 2007/0166443 | A1 * | 7/2007 | Mitchell | A47J 37/047 | 426/523 |
| 2007/0181445 | A1 | 8/2007 | Williams et al. | | |
| 2012/0073994 | A1 * | 3/2012 | Haynes | A45C 1/02 | 206/0.82 |

OTHER PUBLICATIONS

Amazon.com, '1 Airtite Coin Holder Storage Container & 20 Black Ring 40mm Air-Tite Coin Holder Capsules for Silver Eagles', Accessed on Apr. 5, 2018.

Amazon.com, '100 Counting Plastic Coin Capsules Round Coin Holder Case With Storage Organizer Box and EVA Gasket for Coin Collection Supplies, 30 MM by Shxstore', Accessed on Apr. 5, 2018.

Amazon.com, 'Black Capsule Tube & 10 Air-Tite High Relief 38mm Black Ring Coin Holders for 2oz Queen's Beast', Accessed on Apr. 5, 2018.

"CoinLink™ Coin Collecting News", available on http://www.coinlink.com/News/whats-new/pcgs-announces-innovative-ro, dated Mar. 27, 2008, 2 pages.

"NGC Certified Rolls", available on https://www.ngccoin.com/coin-grading/holders/certified-rolls.aspx, dated Jan. 1, 2015, 3 pages.

Cointalk, "Blue Ikes—To open or not to open?", https://www.cointalk.com/threads/blue-ikes-to-open-or-not-to-open.214559/, Sep. 29, 2012, 5.

Cointalk, "Do they make coin spacers?", https://www.cointalk.com/threads/do-they-make-coin-spacers.218452/, Dec. 5, 2012.

Other Information, "1971 Eisenhower Dollar in Original Packaging", Jan. 1, 1971.

Other Information, "PCGS Encapsulated Roll of Coins With Single Spacer", Jan. 1, 2015.

Other Information, "Roll of Silver Eagle Coins with Silicone Washers in a Tamper-Evident Case", Jan. 1, 2015.

Other Information, "Technique for Storing and Transporting Coins Used Internally by Applicant", Jan. 1, 2015.

* cited by examiner

FIG. 5A
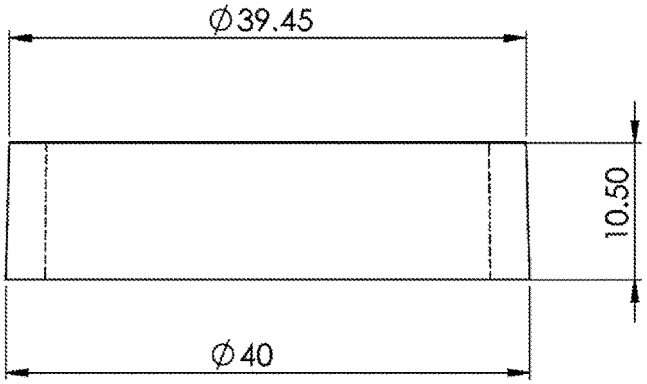
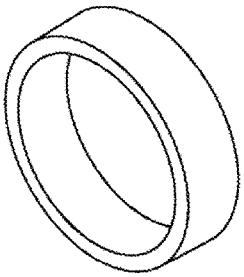
FIG. 5C
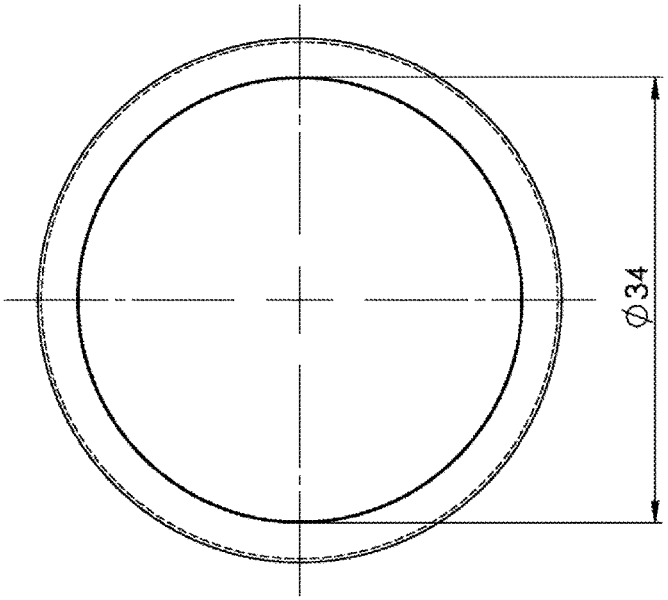
FIG. 5B

FIG. 6C
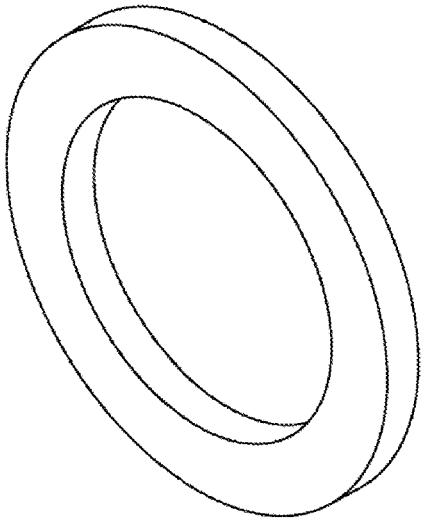
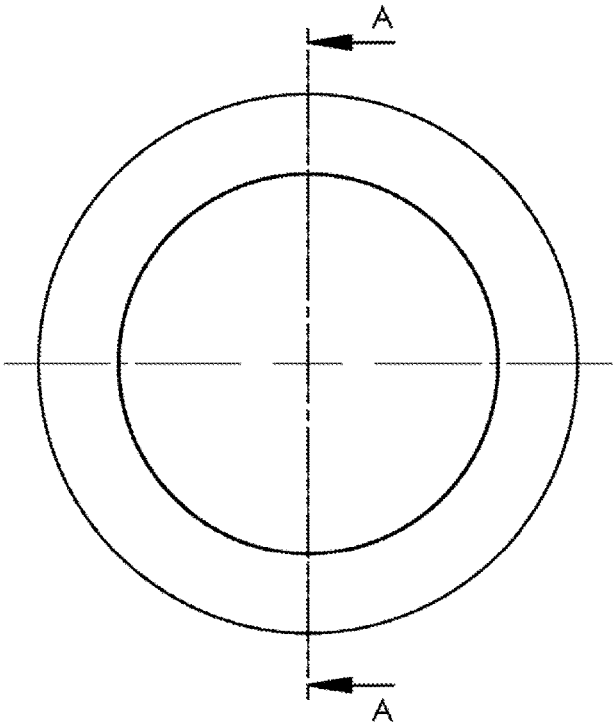
FIG. 6A
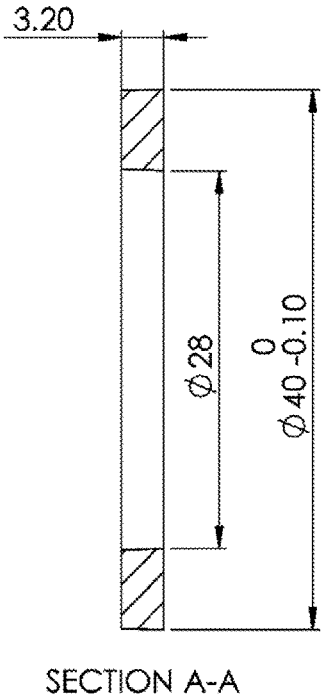
FIG. 6B

USE OF SPACERS TO ACCOMMODATE LESS THAN A CAPACITY NUMBER OF COINS IN A ROLL OF COINS IN A CASE

RELATED APPLICATIONS

The subject matter of this application is related to U.S. Design Patent Application No. 29/579,780, filed on Oct. 3, 2016, and U.S. application Ser. No. 15/492,764, filed Apr. 20, 2017, now U.S. Pat. No. 9,916,711, all of which applications are incorporated herein by reference in their entireties.

BACKGROUND

Collecting coins in roll format has long been very popular. Many denominations of circulating coins are traditionally dispersed in bank-wrapped rolls, which consist of a standard number of coins within a tight paper wrapping. Similarly, many bullion coins are issued in hard plastic rolls. For example, US Mint-issued American Silver Eagles are released from the Mint in rigid plastic rolls of twenty coins that have been unchanged since the late 1980s.

For those who prefer to own coins in roll format, Numismatic Guaranty Corporation of Sarasota, Fla. (NGC) has offered Certified Rolls™, which encapsulate certified coin rolls in a fully transparent holder, making it easy to see the roll of coins through the holder. Certified Rolls' have provided the advantages of an independent guaranty of condition and authenticity. NGC Certified Rolls' have been made from exceptionally high-quality inert materials designed with long-term storage in mind.

An NGC certification label is included on each holder, describing its contents. Where applicable, an adjectival grade is also provided. Security of the roll has also been elevated to the highest levels. Each holder is sonically sealed and tamper-evident. Holographic security tape with a counterfeit-resistant hologram are affixed to each holder. Each Certified Roll is assigned an NGC certification number that can be parsed to correspond to each individual coin within the roll.

NGC Certified Rolls™ have been made available for at least rolls of twenty American Silver Eagles and twenty Chinese Silver Pandas.

SUMMARY

A standard sized coin roll holder is loaded with a stack of alternating coins and spacers such that a variable number of coins can be accommodated in a standard sized holder. The number of coins loaded into the holder can be configured to be one more than the number of spacers, starting with a coin, then a spacer and so on, such that a coin occupies both the first position and the last position in the stack and making a coin face visible at each end. A standard sized holder configured to hold twenty coins can be loaded to accommodate 10 coins using 9 spacers with each of the 9 spacers having a thickness of 10/9 of a coin. The same twenty coin holder can be loaded to accommodate 5 coins using 4 spacers with each of the 4 spacers having a thickness of 15/4 of a coin. A compressible silicone rubber washer can also be included to account for slight variations in coin thickness, thus securing the stack within the available height inside a closed and sealed case.

In one aspect, an encapsulated roll of coins includes a case having a base and a cover, wherein the cover is attached to the base in a tamper-evident manner, and wherein the case is configured to encapsulate a stack of a capacity number of coins within the case so as to prevent movement of the stack of the capacity number coins within an interior height inside the case. The encapsulated roll of coins further includes a stack of included coins encapsulated and positioned securely within the case, the stack of included coins including: a plurality of included coins wherein the plurality is fewer than the capacity number by an omitted number of at least one coins, and at least one spacers interleaved within the plurality of included coins, wherein the at least one spacers provide height to the stack of included coins that would otherwise be provided by at least a portion of the omitted number of coins so as to prevent movement of the stack of included coins within the case.

The stack of included coins can include alternating coins and spacers with one fewer spacers than coins such that one of the included coins is disposed in a first and another of the included coins is disposed in a last position within the stack of included coins. The stack of included coins can include a compressible washer. The compressible washer can be disposed between one of the spacers and one of the coins. The spacers can be constructed of styrene acrylonitrile resin and the compressible washer can be constructed of silicone rubber. At least one of the spacers can be a compressible washer. At least one of the spacers can be substantially incompressible. The spacers can be constructed of styrene acrylonitrile resin and the compressible washer can be constructed of silicone rubber. All of the at least one spacers can have a common thickness. The common thickness can be equal to an aggregate thickness of the omitted number of coins divided by one less than the number of coins in the stack. The stack of included coins can consist of only the included coins and a single spacer. The single spacer can be positioned substantially in a middle of the stack of included coins. The single spacer can be constructed of a substantially compressible material. The at least one spacer can have a diameter substantially equal to a diameter of the coins. The at least one spacer can have a hollow cylinder shape. The at least one spacer can have a solid disc shape. In one aspect, the stack of included coins can include only one spacer.

In one aspect, an encapsulated roll of coins includes a case having a base and a cover, wherein the cover is attached to the base in a tamper-evident manner, and wherein the case is configured to encapsulate a stack of a capacity number of coins within the case so as to prevent movement of the stack of the capacity number coins within the case. The encapsulated roll of coins further includes a plurality of included coins fewer than the capacity number by an omitted number of at least one coins; and at least one spacers, wherein the plurality of included coins and the at least one spacers are arranged in a stack and encapsulated within the case such that the at least one spacers provide height to the stack that would otherwise be provided by the omitted number of coins so as to prevent movement of the stack within the case.

The stack can include alternating coins and spacers with one fewer spacers than coins such that one of the plurality of included coins is disposed in a first and another of the included coins is disposed in a last position within the stack. A compressible washer can be included in the stack.

In one aspect, a method for encapsulating a roll of coins in a case includes providing a case having a base and a cover, wherein the cover is attachable to the base in a tamper-evident manner, and wherein the case is configured to encapsulate a stack of a capacity number of coins within the case so as to prevent movement of the stack of the capacity number coins within the case. The method further includes loading the case with an alternating stack of coins and spacers, with exactly one fewer spacers than coins such that one of the coins is disposed in a first and another of the coins is disposed in a last position within the stack, wherein the number of coins in the stack of coins and spacers is at least two and fewer than the capacity number by an omitted number of at least one coins, and wherein the at least one spacers provide height to the stack of coins and spacers that would otherwise be provided by the omitted number of coins so as to prevent movement of the stack of coins and spacers within the case, when the cover is attached. The method further includes attaching the cover to the case in a tamper-evident manner.

BRIEF DESCRIPTION OF THE DRAWINGS

FIGS. 5A-C illustrate a spacer proportioned for use with the embodiment illustrated in FIG. 3B.

FIGS. 6A-C illustrate a spacer proportioned for use with the embodiment illustrated in FIG. 4B.

DETAILED DESCRIPTION

In the following description, references are made to various embodiments in accordance with which the disclosed subject matter can be practiced. Multiple references to "one embodiment" or "an embodiment" do not necessarily refer to the same embodiment. Particular features, structures or characteristics associated with such embodiments can be combined in any suitable manner in various embodiments. References are also made to the accompanying drawings in which the same reference numbers are used throughout to refer to the same or like components.

Figure 1:
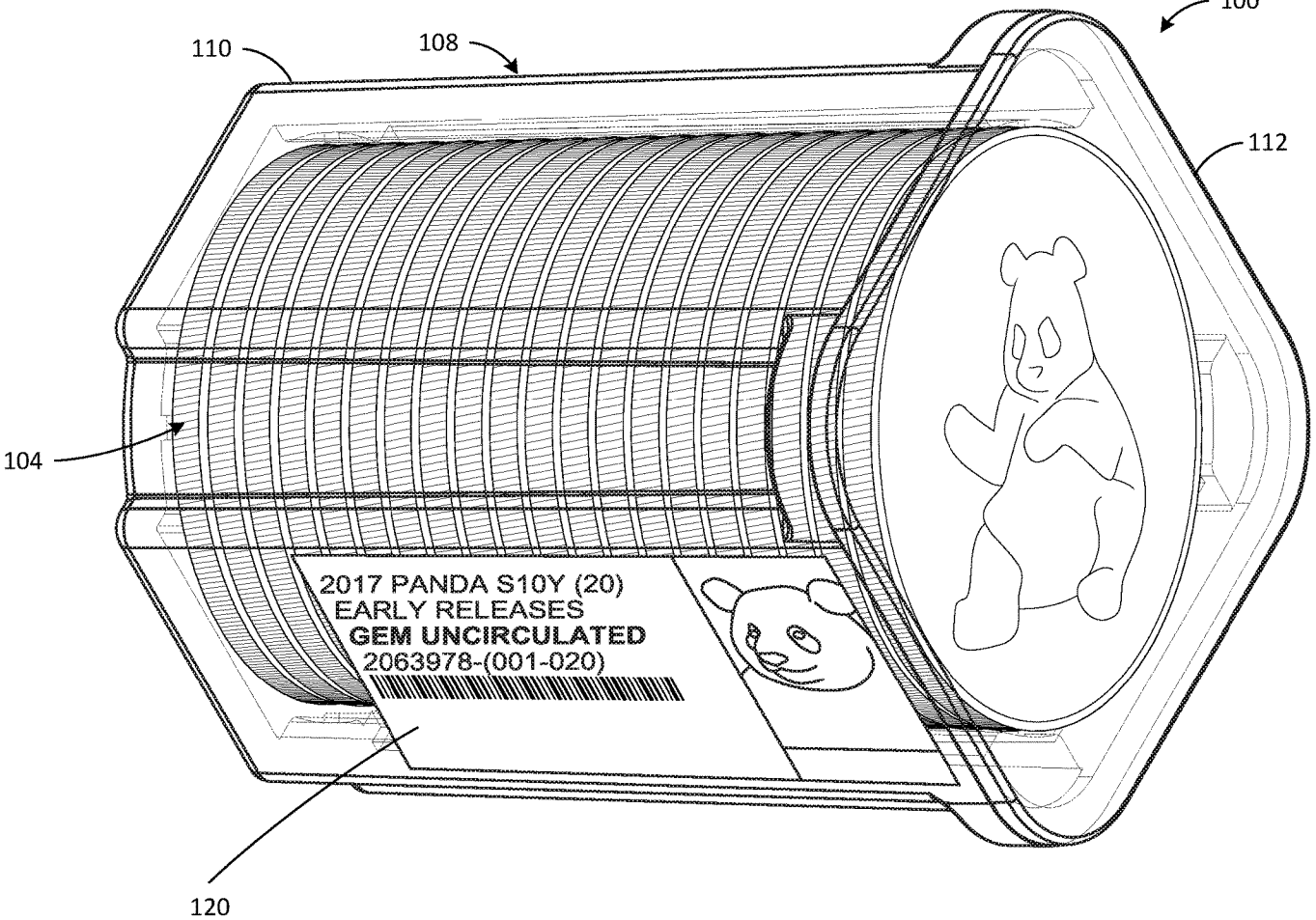
FIG. 1 illustrates an encapsulated roll of twenty certified Chinese Silver Panda coins in a tamper-evident case.

FIG. 1 illustrates an encapsulated roll 100 of twenty certified Chinese Silver Panda coins 104 in a tamper-evident case 108. The case 108 can be made of plastic, such as polycarbonate, and can be made transparent so that the encapsulated coins are visible from outside the case. The case 108 includes a base 110 and a cover 112, which is attached to the base to encapsulate the roll of coins 104 in the case 108. The cover 112 can be ultrasonically welded or glued to the base 110 in a tamper-evident manner such that if the cover is removed, visibly evident damage to the case will occur. A certification label or card 120 can be held in place in a slot within an interior of the case 108 and encapsulated along with the coins 104. The certification label can be created by a certifying and/or grading authority, such as Numismatic Guaranty Corporation, and can indicate the identity, quality or grade and quantity of coins encapsulated in the case. By loading all of the coins 104 in the same orientation in the roll 100, both the obverse and reverse sides of the coins 104 are visible at opposite ends of the roll 100.

The case 108 can be configured or designed to hold a specific diameter of coin securely without movement. The case can also be configured to hold a specific number of coins, such as twenty, each of a certain thickness, within an internal height of the case. Different cases can be designed with different internal dimensions to hold different numbers and types of coins having different diameters and/or thicknesses.

FIGS. 2A-D illustrate the same case 108 of FIG. 1, but configured to accommodate fewer than twenty coins by using spacers 204 to separate and position the coins 104 within the roll 100. The coins 104 can be loaded in the case 108 or positioned in an alternating or interleaved stack of coins and spacers 204. The stack can be created by starting with a coin, then a spacer and so on, such that a coin occupies both the first position and the last position in the roll and making a coin face visible at each end of the roll 100. By doing this, the number of coins loaded into the case 108 will be one more than the number of spacers 204.

Figure 2A:
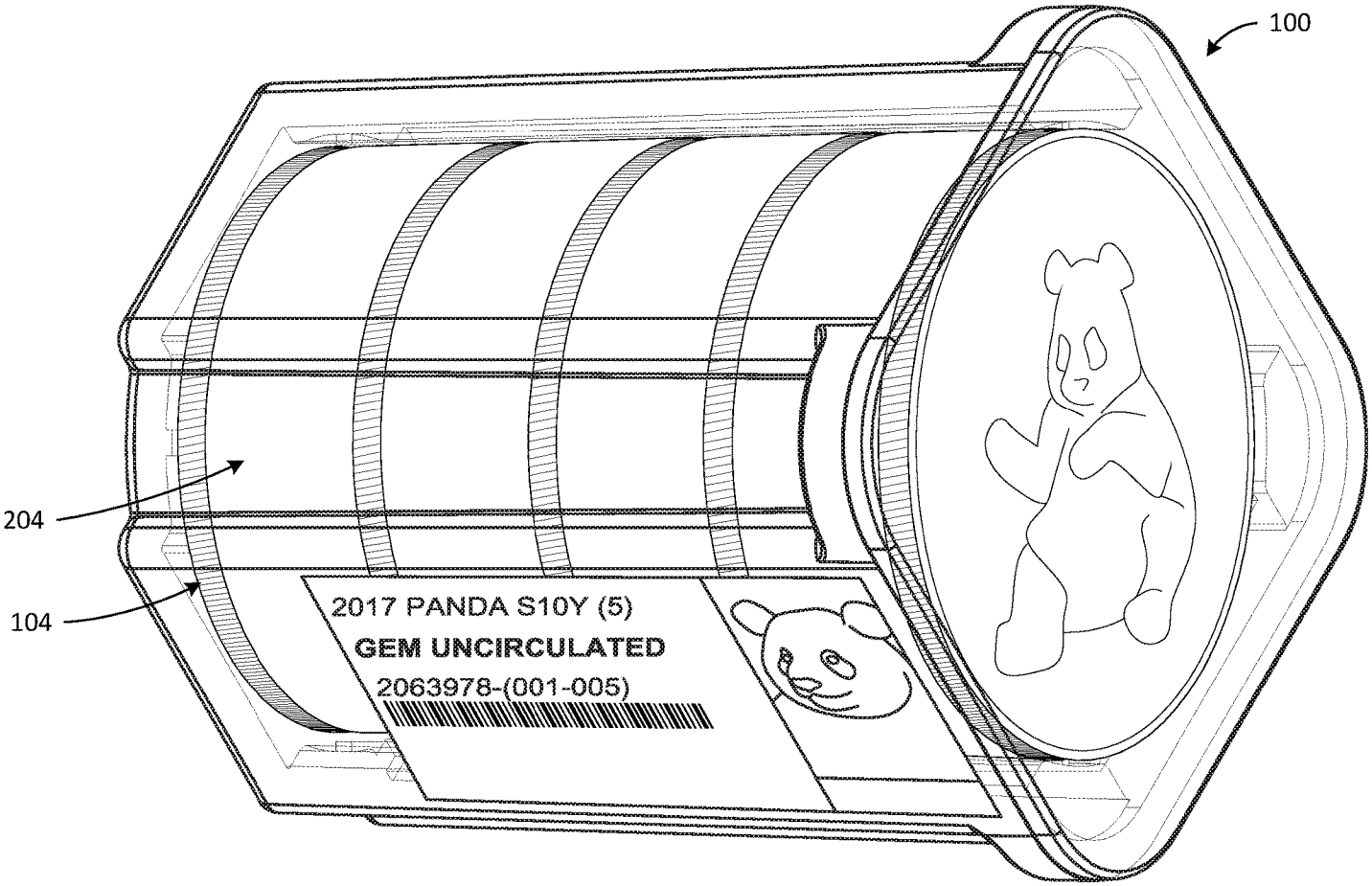
FIGS. 2A-D illustrate the same case of FIG. 1, but configured to accommodate fewer than twenty coins by using spacers to separate and position the coins within the roll.
Figure 2B:
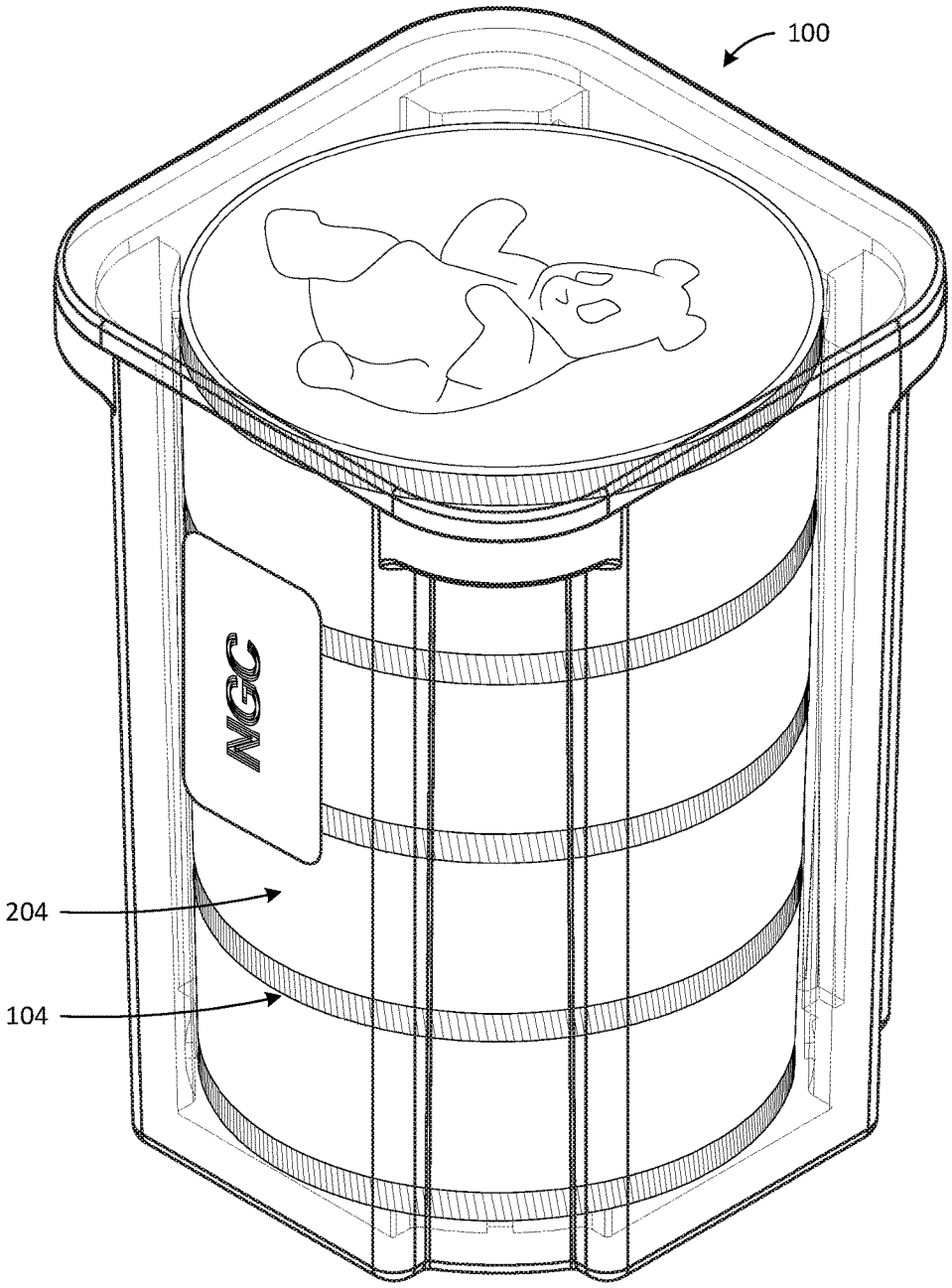
Figure 2C:
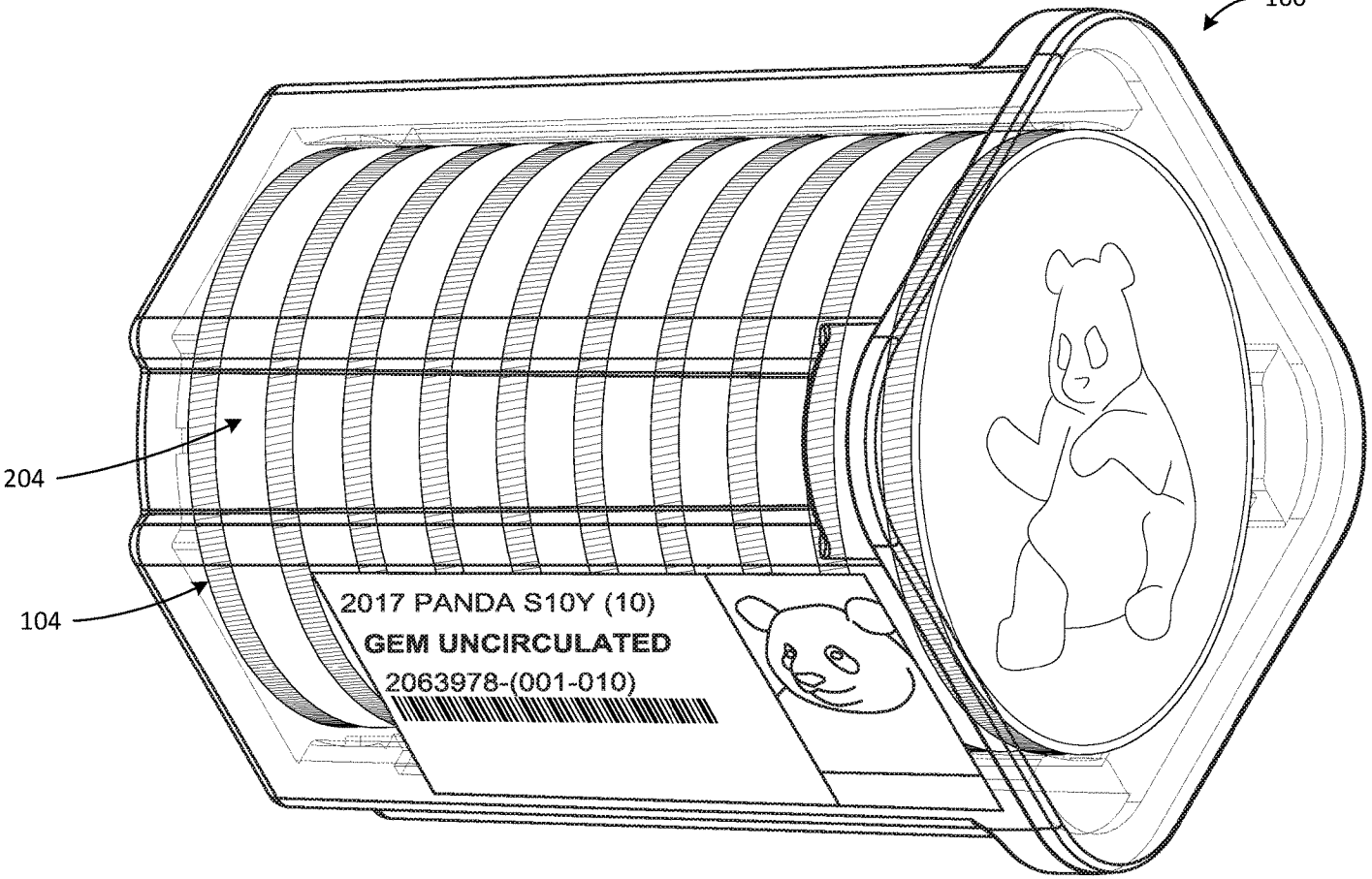
Figure 2D:
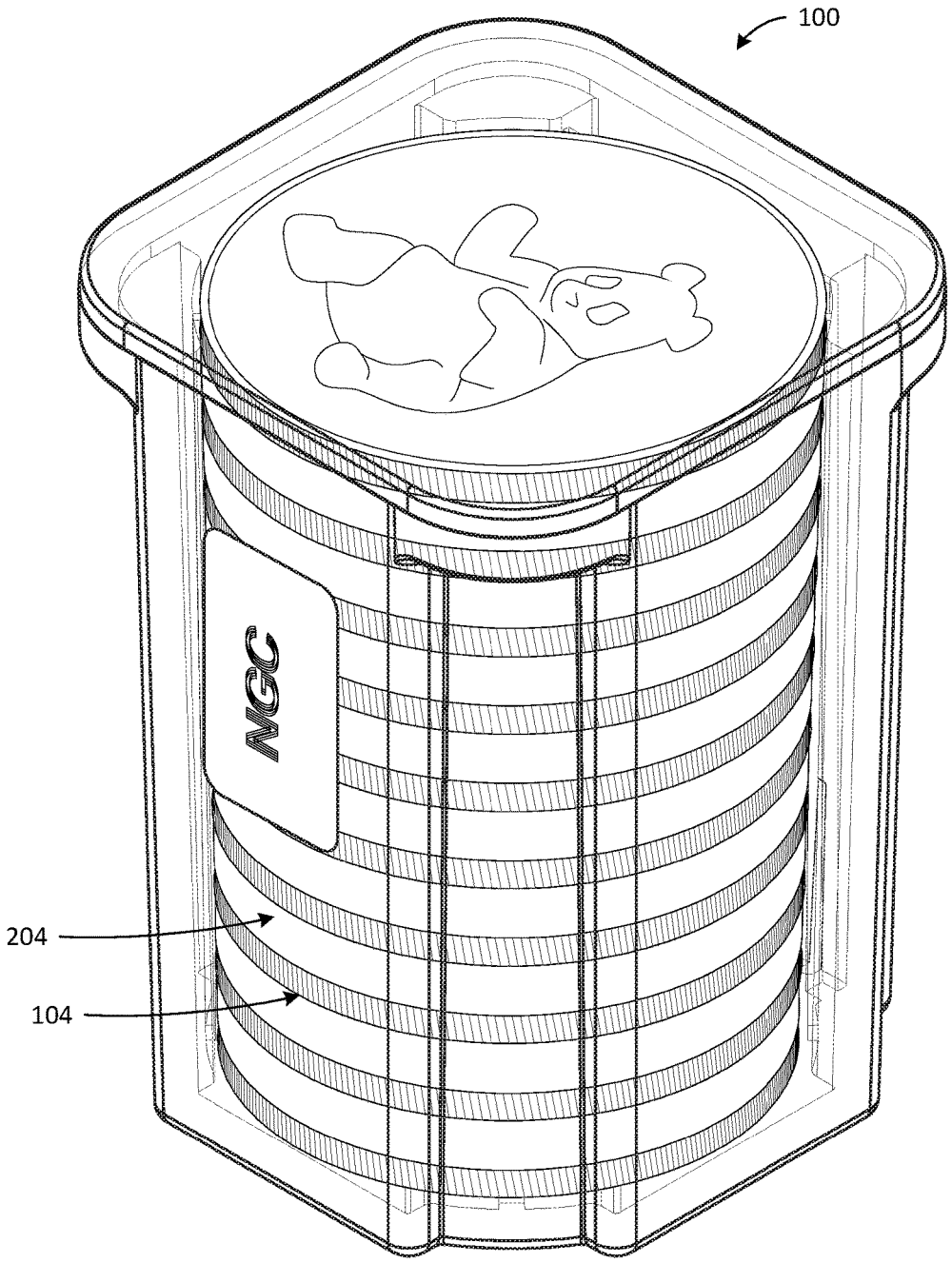

FIGS. 2B and 2D show a view of the case 108 showing a foil hologram that has been hot-stamped to the side of the holder 108.

The spacers 204 can be configured to have a diameter or maximum width substantially matching that of the encapsulated coins, and with an aggregate thickness to occupy any space not occupied by the fewer number of coins, preventing movement within the case 108. The spacers 204 can be made of a translucent or partially translucent material, a transparent material or an opaque material, any of which can, but need not be plastic. For example, the spacers can be made of styrene acrylonitrile resin or polycarbonate. Each spacer can be configured as a hollow cylinder, a solid disc or another hollow or solid shape, such as any polygonal wafer or outline that fits securely within the case. A cylindrical, transparent spacer of sufficient thickness, assuming relatively few coins are encapsulated, can permit the interior faces of coins in the roll to be visible.

As illustrated in FIGS. 2A and 2B, the twenty coin holder 108 is loaded with an alternating stack of five coins and four spacers such that the five coins as separated and positioned by the four spacers within the roll 100. In order to space the coins evenly, the thickness of the omitted coins, which number 15 in this case, can be divided by the number of spacers used, 4 in this case, to determine the thickness of each spacer. Therefore, in this case, each spacer would be 15/4 of the thickness of a coin.

As illustrated in FIGS. 2C and 2D, the twenty coin holder 108 is loaded with an alternating stack of ten coins and nine spacers such that the ten coins are separated and positioned by the nine spacers within the roll 100. In order to space the coins evenly, the thickness of the omitted coins, which number 10 in this case, can be divided by the number of spacers used, 9 in this case, to determine the thickness of each spacer. Therefore, in this case, each spacer would be 10/9 of the thickness of a coin.

More generally, to determine the thickness of each spacer, the aggregate thickness of the coins to be encapsulated can be subtracted from the length of the open space within the case within which the stack of coins and spacers are to be encapsulated, and the resulting value can be divided by one less than the number of coins.

In additional embodiments, different numbers of spacers can be used to occupy space in a standard sized case for fewer than the case's capacity of coins. For example, a single appropriately sized spacer can be positioned substantially in the center of a stack of coins, with approximately half of the included coins positioned contiguously on opposite ends of the roll. Different sized cases can be used to accommodate up to certain capacities of coins, such as up to 5, 10, 20 or 50 coins, with spacers being used to accommodate any empty space in each size of case.

Figure 3B:
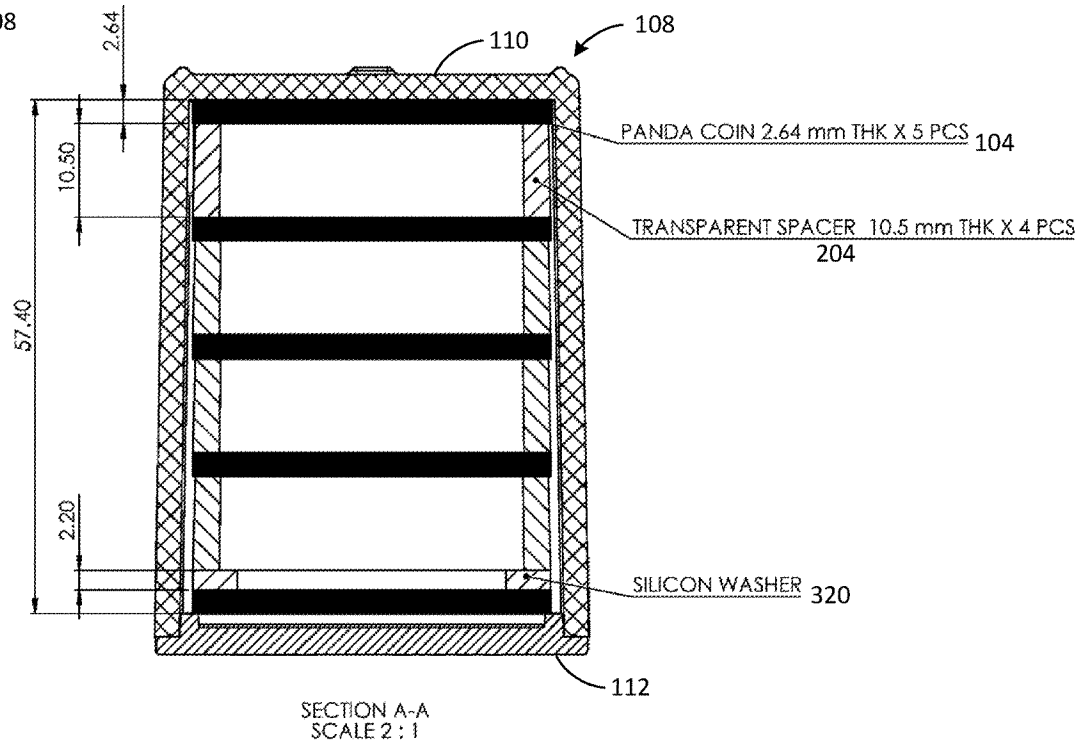
FIGS. 3A, 3B, 4A and 4B illustrate engineering drawings of a twenty coin holder in accordance with two embodiments.
Figure 3A:
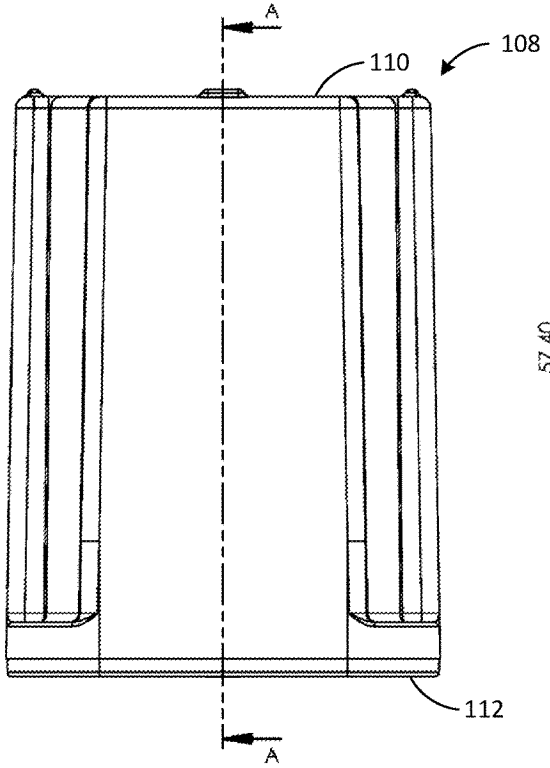
Figure 4B:
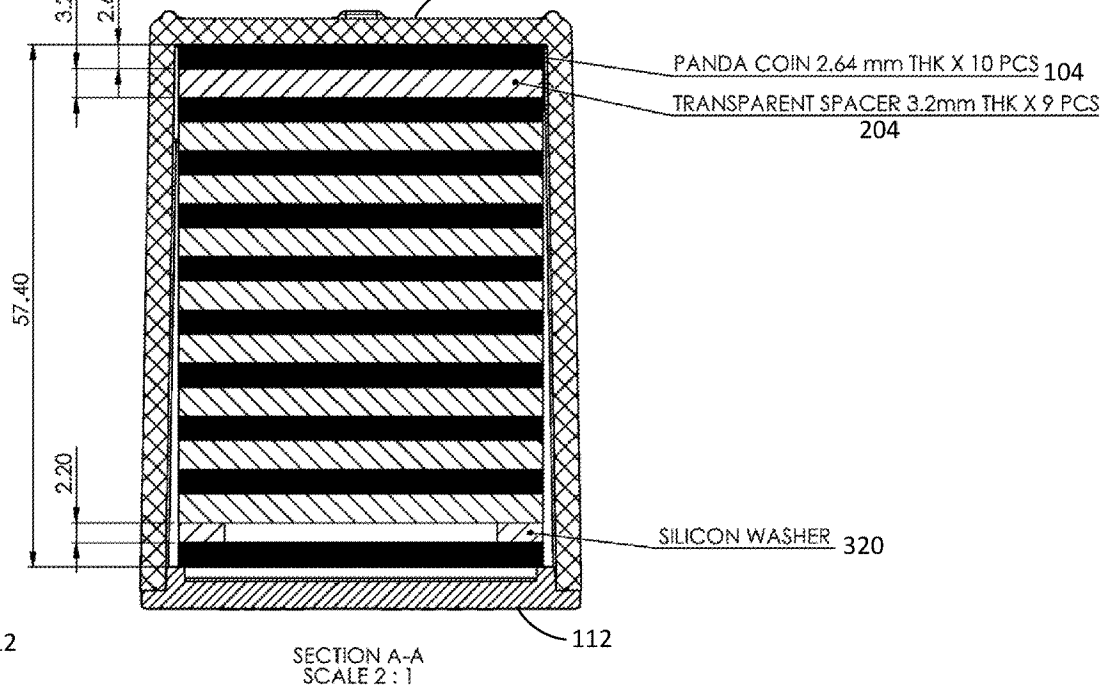
Figure 4A:
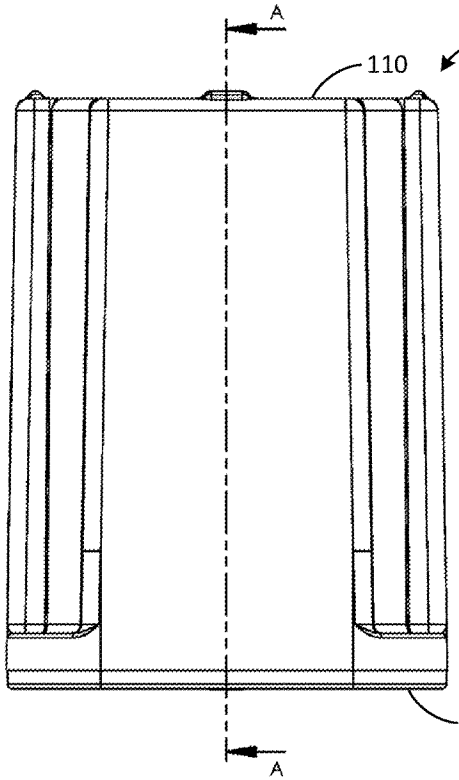

FIGS. 3A, 3B, 4A and 4B illustrate engineering drawings of a twenty coin holder 108 in accordance with two embodiments. FIGS. 3A and 4A show an external elevation view of a closed holder. FIGS. 3B and 4B each show a cross section view of the holder through the plane "A" shown in FIGS. 3A and 4A respectively. Dimensions in FIGS. 3B and 4B are shown in millimeters. The cross section view of 3B shows the holder configured to hold five coins 104 separated by four spacers 204, as well as one washer 320, while the cross section view of 4B shows the holder configured to hold ten coins 104 separated by nine spacers 204, as well as one washer 320.

The washer 320 can be placed between any of the coins and spacers or at the end of the stack, but in the FIGS. 3B and 4B is shown adjacent a coin at one end of the stack and a spacer. The washer 320 can be made of silicone rubber (referred to as silicon in FIG. 3B) which is flexible and compressible, in order to provide sufficient pressure against the adjacent coin and spacer which secures the stack in place within the holder. A silicone rubber or compressible washer can accommodate slight variations in coin thicknesses while still maintaining an adequate pressure to secure the stack in place. The height of the spacers 204 and the washer 320 can be appropriately configured on a case by case basis to accommodate different numbers and thicknesses of coins.

The washer 320 can also or alternatively be a flexible and/or compressible spacer. In some embodiments, one or more of the spacers 204 can be made of a flexible or compressible material, eliminating the need for a separate washer 320.

FIGS. 5A-C illustrate a spacer 204 configured for use with the embodiment illustrated in FIG. 3B. FIGS. 6A-C illustrate a spacer 204 configured for use with the embodiment illustrated in FIG. 4B. Dimensions are shown in millimeters. The spacers 204 of FIGS. 5 and 6 can be made of transparent styrene acrylonitrile resin.

Although the subject matter has been described in terms of certain embodiments, other embodiments, including embodiments which may or may not provide various features and advantages set forth herein will be apparent to those of ordinary skill in the art in view of the foregoing disclosure. The specific embodiments described above are disclosed as examples only, and the scope of the patented subject matter is defined by the claims that follow.

The invention claimed is:

1. An encapsulated roll of coins comprising:

a tamper-evident transparent case having a base and a cover, wherein the cover is attached to the base in a tamper-evident manner such that if the cover is removed, visibly evident damage to the case will occur; and encapsulated within and visible through the transparent case, a stack comprising a plurality of coins and one or more spacers, wherein each of the one or more spacers is interleaved between two of the plurality of coins to form an alternating sequence of coins and spacers with one fewer spacers than coins such that one of the coins in the alternating sequence is disposed in a first position within the stack with a reverse face visible through the case and another of the coins is disposed in a last position within the stack with an obverse face visible through the case, wherein each of the one or more spacers has a thickness at least as great as one of the plurality of coins, and wherein the stack is secured by the case preventing movement of the coins and spacers within the case.

2. The encapsulated roll of coins of claim 1, wherein the stack comprises at least three coins and at least two spacers.

3. The encapsulated roll of coins of claim 2, wherein the stack further comprises a compressible washer.

4. The encapsulated roll of coins of claim 3, wherein the compressible washer is disposed between one of the spacers and one of the coins.

5. The encapsulated roll of coins of claim 4, wherein the at least one spacer is constructed of styrene acrylonitrile resin and wherein the compressible washer is constructed of silicone rubber.

6. The encapsulated roll of coins of claim 2, wherein at least one of the at least one spacers is a compressible washer.

7. The encapsulated roll of coins of claim 6, wherein at least one of the at least one spacers is substantially incompressible.

8. The encapsulated roll of coins of claim 7, wherein the at least one spacer is constructed of styrene acrylonitrile resin and wherein the compressible washer is constructed of silicone rubber.

9. The encapsulated roll of coins of claim 1, wherein all of the one or more spacers have a common thickness.

10. The encapsulated roll of coins of claim 9, wherein the tamper-evident transparent case is configured to encapsulate a capacity number of coins, wherein the capacity number is greater than the plurality number of coins by an omitted number of coins, and wherein the common thickness of the spacers is determined by dividing an aggregate thickness of the omitted number of coins by one less than the plurality number of coins.

11. The encapsulated roll of coins of claim 10, wherein the stack comprises at least two spacers and wherein the common thickness of the at least two spacers is equal to the aggregate thickness of the omitted number of coins divided by one less than the plurality number of coins.

12. The encapsulated roll of coins of claim 1, wherein the stack consists of two coins and a single spacer.

13. The encapsulated roll of coins of claim 12, wherein the single spacer is constructed of a substantially compressible material.

14. The encapsulated roll of coins of claim 1, wherein the one or more spacers have a width substantially equal to a diameter of the plurality of coins.

15. The encapsulated roll of coins of claim 1, wherein the one or more spacers have a diameter substantially equal to a diameter of the plurality of coins.

16. The encapsulated roll of coins of claim 1, wherein the one or more spacers have a hollow cylinder shape.

17. The encapsulated roll of coins of claim 1, wherein the one or more spacers have a solid disc shape.

18. The encapsulated roll of coins of claim 1, wherein the stack comprises no more than one spacer.

19. The encapsulated roll of coins of claim 1, wherein the stack comprises exactly five coins and four spacers.

20. The encapsulated roll of coins of claim 1, wherein the stack comprises exactly ten coins and nine spacers.

* * * * *